US011969103B2

(12) United States Patent
Ballard

(10) Patent No.: US 11,969,103 B2
(45) Date of Patent: Apr. 30, 2024

(54) PORTABLE STADIUM CHAIR

(71) Applicant: Robert Ballard, Barboursville, WV (US)

(72) Inventor: Robert Ballard, Barboursville, WV (US)

( * ) Notice: Subject to any disclaimer, the term of this patent is extended or adjusted under 35 U.S.C. 154(b) by 5 days.

(21) Appl. No.: 17/866,223

(22) Filed: Jul. 15, 2022

(65) Prior Publication Data

US 2024/0016296 A1 Jan. 18, 2024

(51) Int. Cl.

| | |
|---|---|
| ***A47C 4/52*** | (2006.01) |
| ***A47C 1/024*** | (2006.01) |
| ***A47C 3/16*** | (2006.01) |
| ***A47C 7/40*** | (2006.01) |
| ***A47C 7/42*** | (2006.01) |

(Continued)

(52) U.S. Cl.

CPC ..... *A47C 3/16* (2013.01); *A47C 1/024* (2013.01); *A47C 7/46* (2013.01); *A47C 7/626* (2018.08); *A47C 7/725* (2013.01); *A47C 4/52* (2013.01); *A47C 7/029* (2018.08); *A47C 7/402* (2013.01); *A47C 7/407* (2013.01); *A47C 7/425* (2013.01); *A47C 7/628* (2018.08)

(58) Field of Classification Search

CPC ..... A47C 3/16; A47C 7/402; A47C 7/626; A47C 4/52; A47C 7/407; A47C 7/425; A47C 7/628; A47C 7/029; A47C 7/725

USPC ..... 297/17, 188.08, 188.09, 188.1, 217.6, 297/230.1, 252, 352, 452.21, 452.22, 353, 297/387.1, 378.1

See application file for complete search history.

(56) References Cited

U.S. PATENT DOCUMENTS 645,878 A * 3/1900 Tennyson ..... A47C 1/16 297/252 X
672,683 A * 4/1901 Potteiger ..... A47C 1/146 297/378.1

(Continued)

FOREIGN PATENT DOCUMENTS

| | | |
|---|---|---|
| CA | 2241857 | 12/1999 |
| CN | 102783835 | 11/2012 |

(Continued)

OTHER PUBLICATIONS

New Plastic Folding Storage Box Car Folding Chair Box Portable Plastic Folding Box Camping Box Car Storage Box 60I, accessed on Jun. 22, 2022 at https://www.aliexpress.com/item/3256802465941401.html?gatewayAdapt=4itemAdapt Jun. 22, 2022.

*Primary Examiner* — Rodney B White
(74) *Attorney, Agent, or Firm* — BRYAN CAVE LEIGHTON PAISNER LLP

(57) ABSTRACT

A portable chair apparatus for assisting the user with comfort, storage, and transportation includes a base, a seat with an opening, a storage compartment between the base and the seat, a back support column, a lumbar support piece, a handle, and a light. The back support column is adjustable relative to the seat between an open and closed position. The lumbar support piece is adjustable along the back support column and is sized to fit within the opening of the seat when the back support column is in the closed position. The light is on the top surface of the back support column. The chair can further include a handle having a light directed towards the space in front of the user when holding the chair. Other embodiments are described.

20 Claims, 7 Drawing Sheets

(51) Int. Cl.

| | |
|---|---|
| ***A47C 7/46*** | (2006.01) |
| ***A47C 7/62*** | (2006.01) |
| ***A47C 7/72*** | (2006.01) |
| *A47C 7/02* | (2006.01) |

(56) References Cited

U.S. PATENT DOCUMENTS 878,889 A * 2/1908 Miller ..... A47C 1/16 297/352
1,767,925 A 6/1930 Hargreaves
1,852,012 A * 4/1932 Henry ..... A47C 1/16 297/378.1 X
2,147,958 A * 2/1939 Angers ..... A47C 7/407 297/378.1 X
2,216,818 A * 10/1940 Kuhlman ..... A47C 27/081 4/578.1
2,237,188 A * 4/1941 McClelland ..... A47C 1/16 297/378.1
2,508,769 A * 5/1950 Osbon ..... B63B 29/04 297/378.1 X
2,536,157 A * 1/1951 Campanelli ..... A47C 1/16 297/252 X
2,540,672 A * 2/1951 Holmes ..... A47D 1/106 297/378.1 X
2,552,476 A * 5/1951 Barton ..... A47C 7/029 297/452.22 X
2,612,207 A * 9/1952 Branson ..... B60N 2/3095 297/378.1 X
2,620,860 A * 12/1952 McEntire ..... A47C 1/146 297/378.1 X
D169,366 S * 4/1953 Feldman ..... 297/452.22 X
2,732,563 A * 1/1956 Shively ..... A61G 9/003 297/378.1 X
2,784,769 A * 3/1957 Fisher ..... A47C 1/023 297/452.2 X
2,957,515 A * 10/1960 Gibson ..... A47C 1/16 297/378.1 X
3,580,633 A * 5/1971 Du Priest ..... A47C 1/16 297/17 X
3,594,039 A 7/1971 Harp
4,474,407 A * 10/1984 Nazar ..... A47C 1/146 297/378.1 X
4,527,830 A * 7/1985 Meyers ..... A47D 11/002 297/17 X
4,556,250 A * 12/1985 Chapman ..... A47C 7/62 297/275
4,652,048 A * 3/1987 Nazar ..... A47C 7/626 297/188.01 X
4,715,652 A * 12/1987 Ward ..... A47C 1/16 297/252
4,781,413 A 11/1988 Shumack, Jr.
4,799,731 A * 1/1989 Brown ..... A47C 7/626 297/17 X
4,871,209 A 10/1989 Handelman
5,067,771 A * 11/1991 Ellis ..... A47C 1/16 297/352 X
5,288,132 A 2/1994 Vaughn
5,318,342 A * 6/1994 Hale ..... A47C 4/52 297/17 X
5,421,637 A 6/1995 Lemburg
5,573,288 A 11/1996 Raffensperger
5,944,379 A 8/1999 Yates
5,979,989 A * 11/1999 Herbst ..... A47C 7/029 297/452.22 X
6,015,190 A 1/2000 Wend
6,029,295 A * 2/2000 Larmour ..... A47G 9/10 5/636
6,082,816 A 7/2000 Gottlieb et al.
6,125,486 A * 10/2000 Rabon ..... A47C 7/029 297/452.41
6,126,233 A * 10/2000 Gaetano ..... B60N 2/286 297/217.6
6,189,973 B1 * 2/2001 Wu ..... A47C 4/52 297/378.1 X
6,343,837 B1 2/2002 Gage
6,494,539 B2 * 12/2002 Frank ..... A47C 4/04 297/378.1 X
6,502,902 B1 * 1/2003 Romero ..... A47C 1/16 297/352
7,125,079 B1 10/2006 Lee et al.
7,431,393 B1 * 10/2008 Huang ..... B62J 6/04 297/217.6 X
8,007,043 B1 * 8/2011 Vuong ..... B60N 2/2821 297/217.6 X
8,321,979 B2 * 12/2012 Goodwin ..... A61G 7/05723 5/652
8,403,410 B1 3/2013 Pinger et al.
8,960,799 B2 * 2/2015 Yoon ..... A47C 7/021 297/378.1 X
9,573,495 B2 * 2/2017 Haggmark-Bell ... B60N 2/2866
9,783,092 B2 * 10/2017 Bergmark ..... B60N 2/686
10,098,463 B1 * 10/2018 Cheng ..... A47C 7/021
11,044,998 B1 * 6/2021 Garcia ..... B65D 81/18
2004/0000806 A1 * 1/2004 Watkins ..... A61G 5/12 297/378.1
2005/0225143 A1 * 10/2005 Sun ..... B60N 2/3047 297/378.1
2006/0202533 A1 * 9/2006 Goodman ..... A47C 7/402 297/352
2010/0045078 A1 * 2/2010 Lee ..... A47C 7/407 297/188.1
2012/0299339 A1 * 11/2012 Birch ..... A47C 7/62 297/217.6 X
2013/0200025 A1 * 8/2013 Sempek ..... B25H 3/06 297/452.21
2017/0224118 A1 8/2017 Fernandez
2019/0143853 A1 * 5/2019 Seeborun ..... B60N 2/5621 297/135
2020/0383485 A1 12/2020 Snyder
2023/0129979 A1 * 4/2023 Djankovich ..... A47C 9/002 297/32

FOREIGN PATENT DOCUMENTS

| | | | |
|---|---|---|---|
| CN | 106333538 | 1/2017 | |
| CN | 211795380 | 10/2020 | |
| DE | 10227070 | 1/2004 | |
| EP | 4011245 | 6/2022 | |
| KR | 2017010350 A * | 1/2017 | ..... A47C 3/16 |

* cited by examiner

900

PORTABLE STADIUM CHAIR

TECHNICAL FIELD

The present disclosure generally relates to stadium seats, and more particularly to a portable stadium chair.

BACKGROUND

This section provides background information related to the present disclosure which is not necessarily prior art. The section headings used herein are solely for organization purposes and are not to be construed as limiting the subject matter described in any way.

People often transport food, drinks, apparel, and other personal items with them to gatherings such as sporting events, outdoor performances, and fairs held in stadium like venues. People may transport their own seats, or rent seats from the venue, to increase their comfort level while sitting. Users may struggle to identify their seat in the dark or amongst other similarly appearing chairs. Prior seats with storage compartments were inconvenient because the location of storage interfered with foot or back space or was not accessible to the user when the chair was in use. Additionally, the lack of adjustable back and lumbar supports in previous portable chairs, failing to accommodate each user's specific back needs, limited the comfort provided by such chairs.

SUMMARY OF THE DISCLOSURE

This section provides a general summary of the disclosure, and is not a comprehensive disclosure of its full scope or all of its features.

Among the various aspects of the present disclosure is a portable chair apparatus as substantially shown and described.

Embodiments of the present disclosure provide a portable chair apparatus for assisting the user with comfort, storage, and transport of the device. Additional embodiments of the present disclosure provide a method of providing a portable chair. This portable chair can comprise a base, a seat, a storage compartment, a back support column, a lumbar support piece, a handle, and a light.

Additional embodiments include a method of providing a portable chair. The method can include providing a base, providing a seat, providing a storage compartment, providing a back support column, providing a lumbar support piece, providing a handle, and providing a light.

The seat is for receiving a user thereon. The seat can comprise an opening. Additional embodiments include a seat having a thickness that tapers, increasing in depth from less than 2 inches at the edge of the seat that is proximate to the back support column to at least 2 inches at the edge of the seat that is distal from the back support column.

The storage compartment can be located between the base and the seat of the chair.

The back support column can be adjustable relative to the seat between an open position and a closed position. The open position of the back support column can be oriented between 90 and 160 degrees from the base. The closed position of the back support column can be oriented between 0 and 45 degrees from the base.

The lumbar support piece can be adjustable along the back support column. The lumbar support piece can be sized to fit within the opening of the seat when the back support column is in the closed position. The lumbar support piece can be removably attached to the back support column. In one embodiment, the lumbar support piece has a height that is at least approximately 6 inches, a width that is at least approximately 8 inches, and a thickness that is at least approximately 2.4 inches.

The handle is accessible to the user for transport of the portable chair. The handle can be on the back support column. A second handle can be accessible to the user when the back support column is in the closed position.

The light can be located on the back support column. In one embodiment, the light is an LED colored light. The light may be adjustable to display different colors. The light may be adjustable to flash at one or more intervals or other illumination series. A second light may be located on the second handle of the chair. The second light can be oriented to illuminate a space in front of the user when holding the chair by the second handle, such as with the back support column in the closed position.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Figure 1:
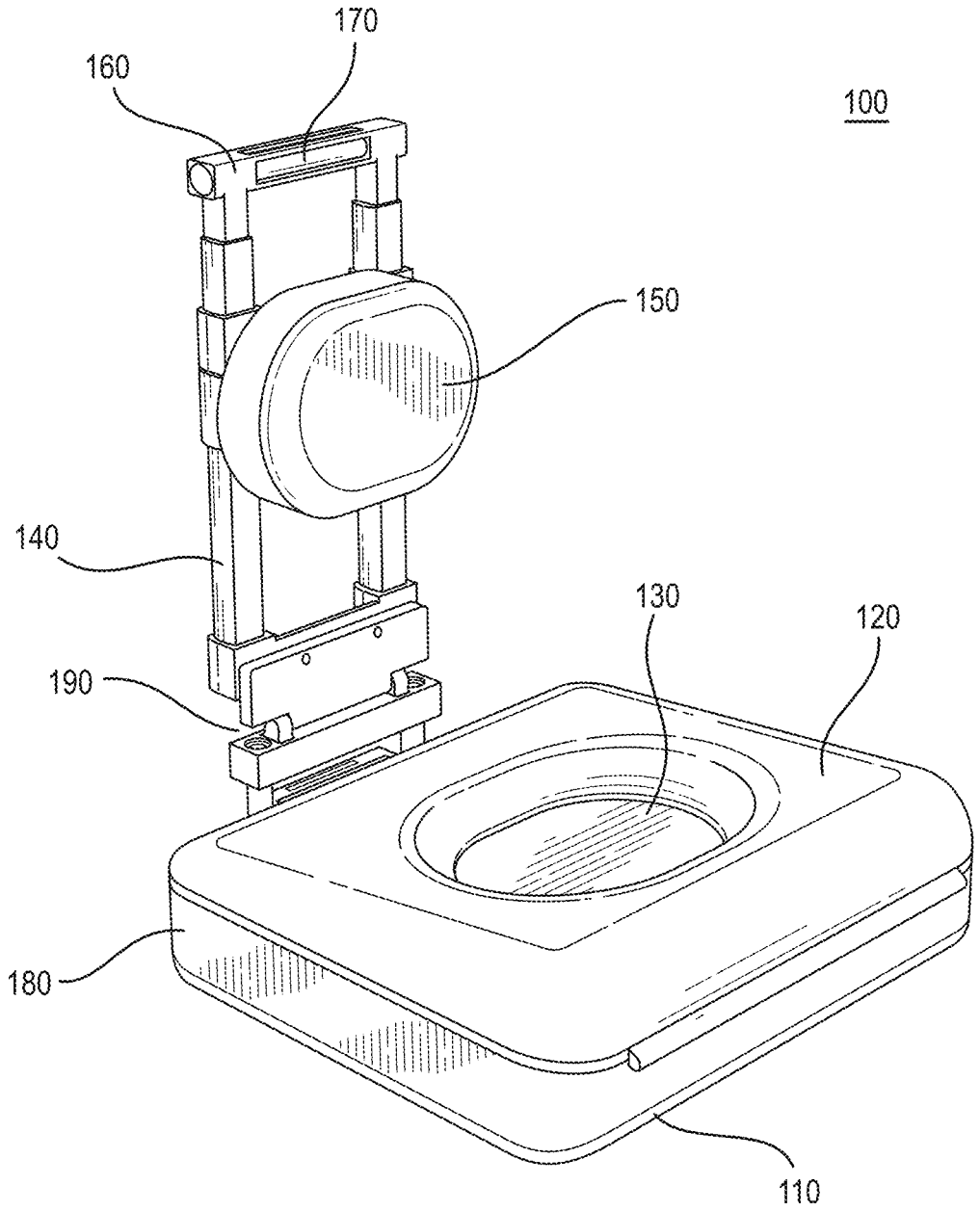
FIG. 1 is a front, top, right side perspective view of a portable chair apparatus, according to an embodiment of the present invention, with a back support column in an open position.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," and the like in the description and in the claims are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, when introducing elements of the present invention or the illustrated embodiments thereof, the articles "a," "an," "the," and "said" are intended to mean that there are one or more of the elements. The terms "comprising," "including," and "having" are intended to be inclusive and mean that there may be additional elements other than the listed elements. For example, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

As defined herein, "approximately" can, in some embodiments, mean within plus or minus ten percent of the stated value. In other embodiments, "approximately" can mean within plus or minus five percent of the stated value. In further embodiments, "approximately" can mean within plus or minus three percent of the stated value. In yet other embodiments, "approximately" can mean within plus or minus one percent of the stated value.

DETAILED DESCRIPTION OF EXAMPLES OF EMBODIMENTS

Example embodiments will now be described more fully with reference to the accompanying drawings.

Before any aspects of the disclosure are explained in detail, it will be understood that the disclosure is not limited in its application to the details of construction and the arrangement of components set forth in the following description or illustrated in the following drawings. The disclosure is capable of other aspects and of being practiced or of being carried out in various ways. Also, it will be understood that the phraseology and terminology used herein is for the purpose of description and should not be regarded as limiting. The use of "including," "comprising," or "having" and variations thereof herein is meant to encompass the items listed thereafter and equivalents thereof as well as additional items. All numbers expressing measurements and so forth used in the specification and claims are to be understood as being modified in all instances by the term "approximately."

Figure 2:
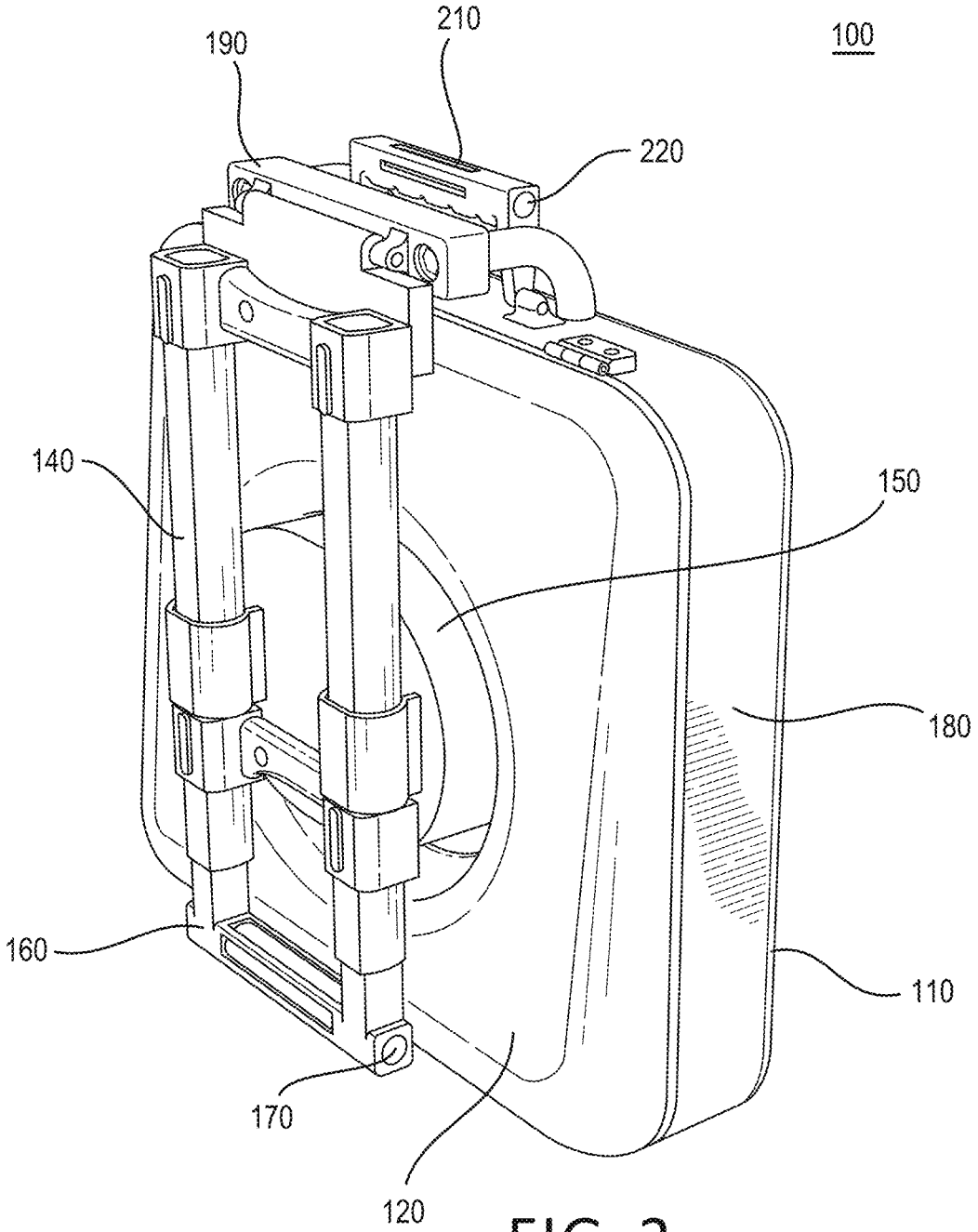
FIG. 2 is a rear, top, left side perspective view of the portable chair apparatus of FIG. 1, with lights illuminated and a back support column in the closed position.
Figure 3:
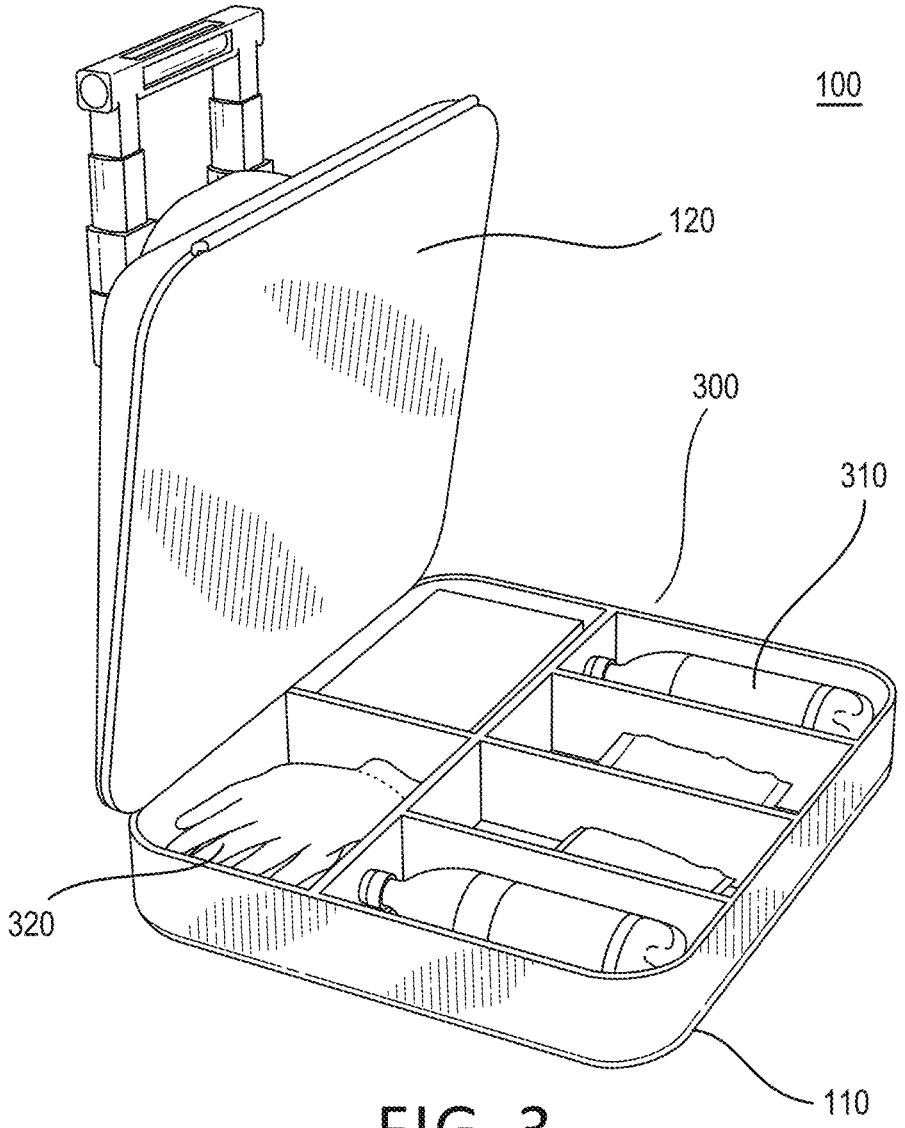
FIG. 3 is a top, front, right side perspective view of the portable chair apparatus of FIG. 1, with the seat raised to an open position to show a storage compartment.
Figure 5:
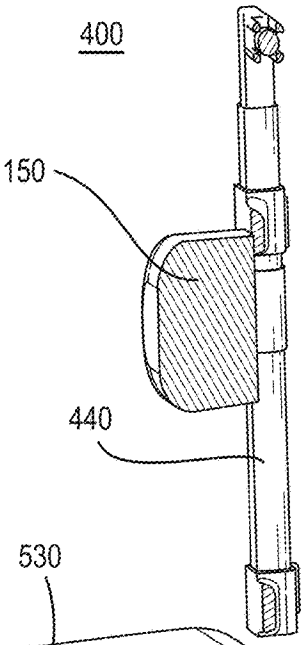
FIG. 5 is a top, front, left side perspective cut-out view of the portable chair apparatus of FIG. 4, with a back support column in an open and detached position.
Figure 5:
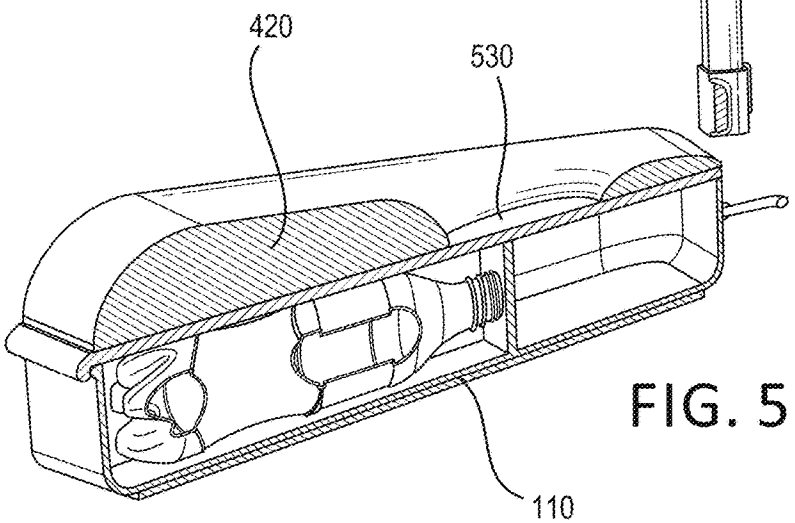
Figure 4:
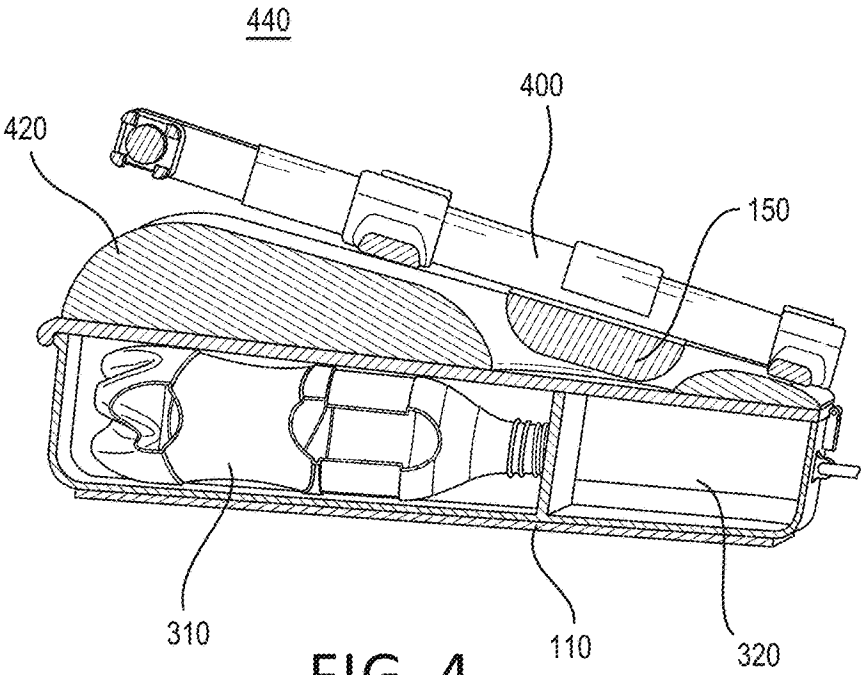
FIG. 4 is a left side elevational cut-out view of a portable chair apparatus, according to another embodiment of the present invention, with a back support column in a closed position.
Figure 6:
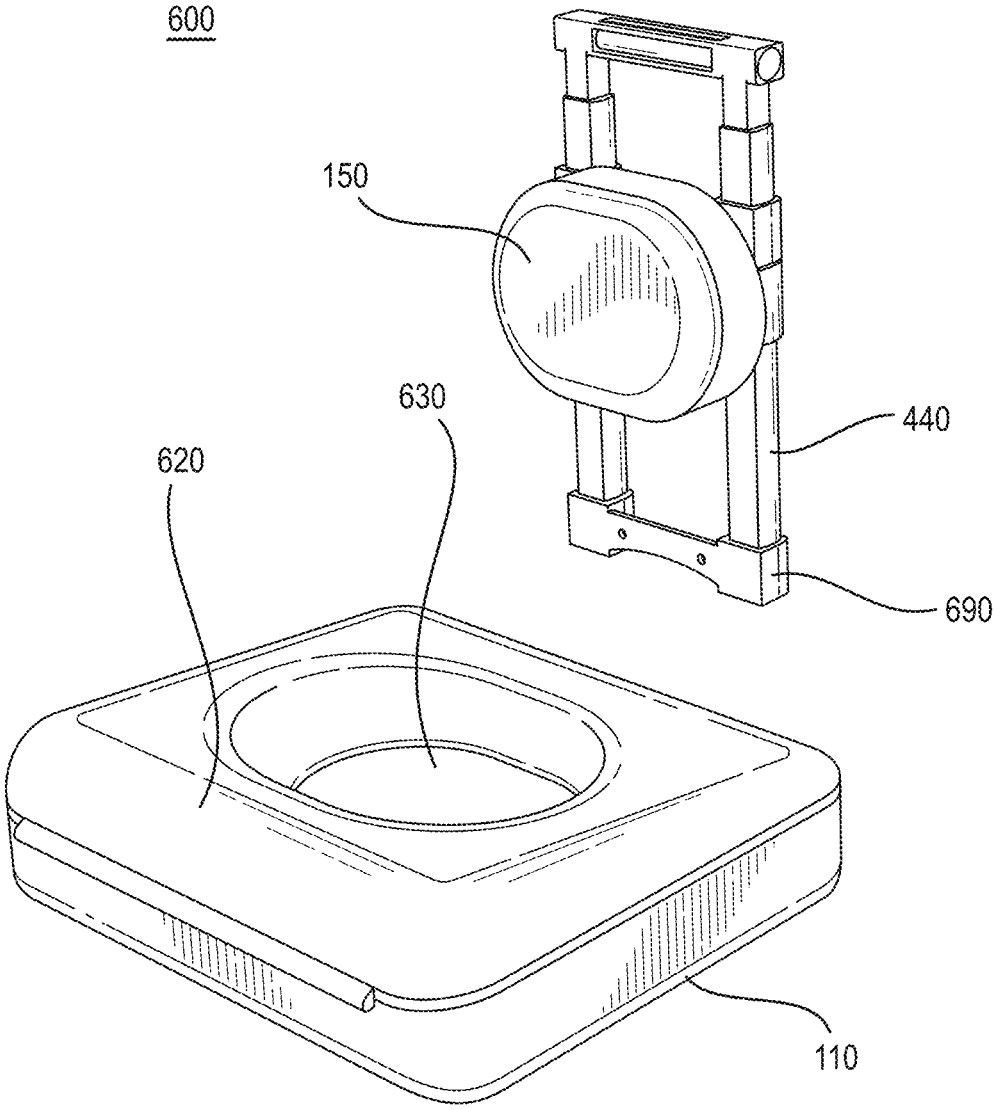
FIG. 6 is a top, front, left side view of a portable chair apparatus, according to another embodiment of the present invention, with the back support column in an open and detached position.

Turning to the drawings, FIG. 1 illustrates a front, top, right side perspective view of a portable chair apparatus 100, showing a back support column 140 in an open position. FIG. 2 illustrates a rear, top, left side perspective view of portable chair apparatus 100, showing back support column 140 in a closed position. FIG. 3 illustrates a front, top, right side perspective view of portable chair apparatus 100, with a seat 120 raised to an open position to show storage compartment 300. FIG. 4 illustrates a left side elevational cut-out view of portable chair apparatus 400, showing a back support column 440 in a closed position. FIG. 5 illustrates a top, front, left side perspective cut-out view of portable chair apparatus 400 with a back support column 440 in an open and detached position. FIG. 6 illustrates a top, front, left side perspective view of a portable chair apparatus 600 with a back support column 440 in an open and detached position.

An embodiment of a portable stadium chair for assisting the user with comfort, storage, and transport of personal items is indicated generally as 100 in the figures. Portable chair apparatus 100 is merely exemplary, and embodiments of the portable chair apparatus are not limited to embodiments presented herein. The portable chair apparatus can be employed in many different embodiments or examples not specifically depicted or described herein. As shown in FIGS. 1-3, portable chair apparatus 100 can comprise a base 110, seat 120, storage compartment 300, back support column 140, a lumbar support piece 150, handles (e.g. 160, 210), a light 170, side walls 180, and/or a back support column mount 190.

In another embodiment, as illustrated in FIGS. 4 and 5, portable chair apparatus 400 can be similar to portable chair apparatus 100 with various elements that are similar or identical. Portable chair apparatus 400 is merely exemplary, and embodiments of the portable chair apparatus are not limited to embodiments presented herein. The portable chair apparatus can be employed in many different embodiments or examples not specifically depicted or described herein. As shown in FIG. 4, portable chair apparatus 400 can include base 110, a seat 420 (which can be similar to seat 120 (FIG. 1)), an opening 530 in seat 420, a back support column 440 (which can be similar to back support column 140 (FIG. 1)), and/or lumbar support piece 150. Seat 420 as shown generally in FIGS. 4 and 5 has a thickness that tapers, increasing in depth from less than approximately 2 inches at an edge of seat 420 that is proximate to back support column 440 to at least approximately 2 inches at an edge of seat 420 that is distal from back support column 440. In another embodiment (not shown), the thickness of the seat may taper so that the thickness decreases in depth from the edge of the seat that is proximate to the back support column to the edge of the seat that is distal from the back support column, such as for a booster seat. Opening 530 as shown generally in FIG. 5 is located closer to the edge of seat 420 near back support column 440 when back support column 440 is in the open position. In other embodiments, the opening 630 may be centered on the top surface of the seat as shown generally in FIG. 6. In yet other embodiments (not shown), the opening may be located closer to the edge of the seat that is distal from the area of the seat that is proximate to the back support column when the back support column is in the open position.

In another embodiment, as illustrated in FIG. 6, portable chair apparatus 600 can be similar to portable chair apparatus 100 (FIG. 1) or 400 (FIG. 4) with various elements that are similar or identical. Portable chair apparatus 600 is merely exemplary, and embodiments of the portable chair apparatus are not limited to embodiments presented herein. The portable chair apparatus can be employed in many different embodiments or examples not specifically depicted or described herein. As shown in FIG. 6, portable chair apparatus 600 can include base 110, a seat 620 (which can be similar to seat 120 (FIG. 1) and/or seat 420 (FIG. 4)), an opening 630 in seat 620 (which can be similar to opening 530 (FIG. 5) and/or opening 130 (FIG. 1)), back support column 440, lumbar support piece 150, and/or a back support column mount 690. Seat 620 has a thickness that tapers, similarly or identical as described above for seat 420 (FIG. 4). Opening 630 as shown generally in FIG. 6 is centered between the edge of seat 620 located near back support column 440 when back support column is in the open position and the edge of seat 620 that is distal from back support column 440. In an embodiment as shown generally in FIG. 6, back support column mount 690 may be used to secure back support column 440 to seat 620, side walls (such as how a back support column mount 190 of portable chair apparatus 100 attaches back support column 140 to side walls 180 of portable chair apparatus in FIG. 1), or base 110.

Figure 8:
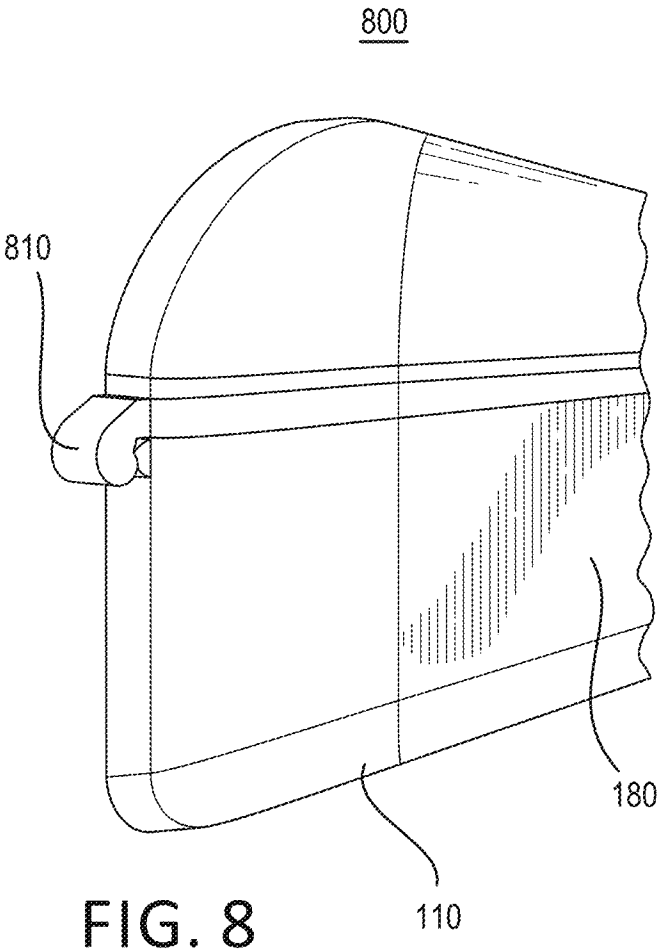
FIG. 8. is a front, side view of a seat removably attached to a side wall of the base of FIGS. 1-6 and enclosing a storage compartment.

Referring now to FIGS. 1-6, base 110 may be in the shape of a square, a rectangle, a circle, or any other geometric shape such that the side walls extending from the edge of base 110 can support the seat (e.g., 120, 420, 620) and provide room for an interior storage compartment (e.g., 300 in portable chair apparatus 100 of FIGS. 1-3) located between base 110 and the seat (e.g., 120, 420, 620). Base 110 can be made from a polymeric material, aluminum, steel, plastic, wood, or any 3D printed material. Base 110 and side walls 180 of the storage compartment 300 can have one or more of a variety of material finishes (e.g., no finish, frosted, pebbled, flocked, matte, glossy, laced, canvas, embossed, satin, no-glare, corrugated, powder coat, paint, etc.). In a preferred embodiment, base 110 may have at least one fastener to releasably engage base 110 with another surface, such as the top and/or sides of a bleacher seat. In another preferred embodiment, the base 110 of the chair may be placed on top of and/or engaged with a ground surface such as grass, asphalt, cement, gravel, an athletic court, or other surface. Jumping ahead in the drawings, in a preferred embodiment, as shown generally in FIG. 8, side walls 180 of base 110 may have at least one fastener 810 to releasably engage the seat to secure the contents of the storage compartment in a temperature controlled area.

Figure 9:
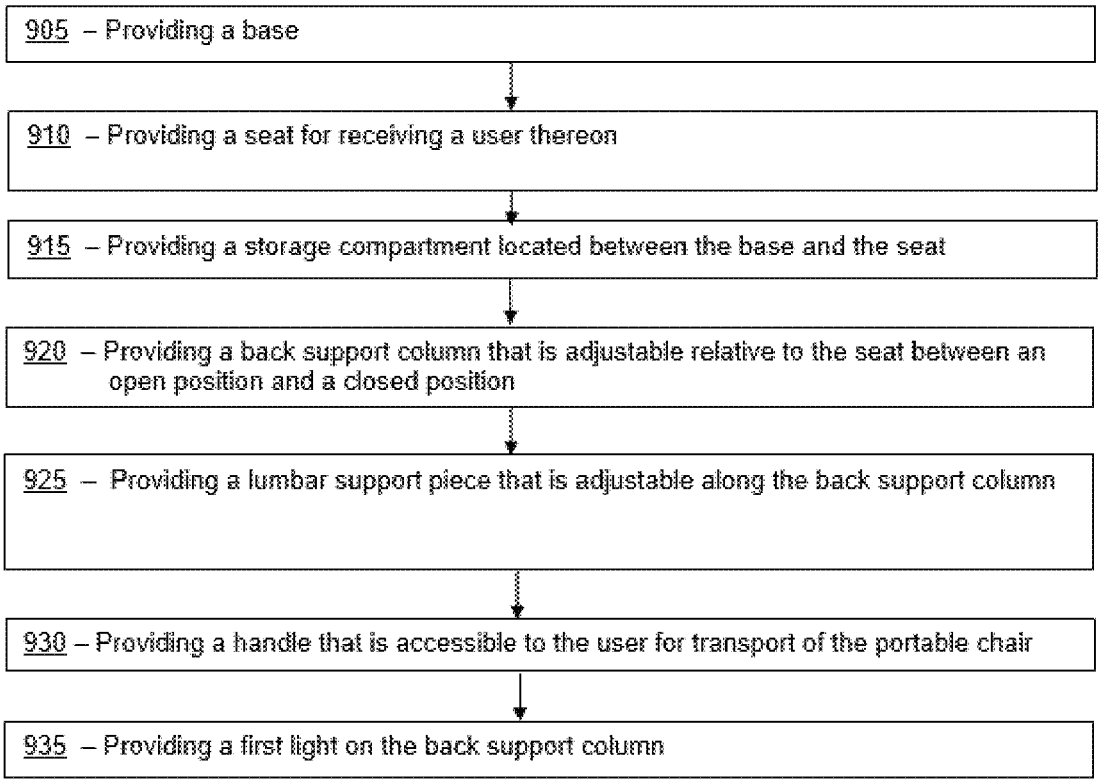
FIG. 9 is a flow chart of a method for providing a portable chair, according to another embodiment of the present invention.

Turning ahead in the drawings, FIG. 9 illustrates a flow chart for an embodiment of a method 900 of providing a portable chair. Method 900 is merely exemplary and is not limited to the embodiments presented herein. Method 900 can be employed in many different embodiments or examples not specifically depicted or described herein. In some embodiments, the procedures, the processes, and/or the activities of method 900 can be performed in the order presented. In other embodiments, the procedures, the processes, and/or the activities of the method 900 can be performed in any other suitable order. In still other embodiments, one or more of the procedures, the processes, and/or the activities in method 900 can be combined or skipped. In some embodiments, the portable chair can be similar or identical to portable chair apparatus 100 (FIG. 1), 400 (FIG. 4), and/or 600 (FIG. 6).

As shown in FIG. 9, method 900 can include an activity 905 of providing a base. The base can be similar or identical to base 110 (FIGS. 1-6). Method 900 also can include an activity 910 of providing a seat. The seat can be similar or identical to seat 120 (FIG. 1), 420 (FIG. 4), and/or 620 (FIG. 6). Method 900 also can include an activity 915 of providing a storage compartment. The storage compartment can be similar or identical to storage compartment 300 (FIG. 3). Method 900 also can include an activity 920 of providing a back support column. The back support column can be similar or identical to the back support column 140 (FIG. 1) and/or 440 (FIG. 4). Method 900 can also include an activity 925 of providing a lumbar support piece. The lumbar support piece can be similar or identical to lumbar support piece 150 (FIG. 1). Method 900 also can include an activity 930 of providing a handle. The handle can be similar or identical to the handle 160 (FIG. 1) and/or 210 (FIG. 2). Method 900 also can include an activity 935 of providing a light. The light can be similar or identical to the light 170 (FIG. 1) and/or light 220 (FIG. 2).

In one embodiment, activity 910 of providing a seat may include providing a seat with an opening for receiving a user thereon. Activity 915 of providing a storage compartment may include providing a storage compartment that is located between the base that is provided in activity 905 and the seat that is provided in activity 910. Activity 925 of providing a lumbar support piece may include providing a lumbar support piece that is adjustable along the back support column wherein the lumbar support piece provided is sized to fit within the opening of the seat that is provided when the back support column that is provided is in the closed position. The handle that is provided in activity 930 may include providing a handle that is accessible to the user for transport of the portable chair. The light that is provided in activity 935 may include providing a light that is on the back support column that is provided.

The seat (e.g., 120, 420, 620) for receiving a user thereon can be opposite of base 110. In another embodiment, the seat may be located above the base at an angle that is not parallel to the surface of the base. The seat (e.g., 120, 420, 620) can comprise an opening (e.g., 130, 530, 630). The opening (e.g., 130, 530, 630) can be in the shape of a square, a rectangle, a circle, or any other geometric shape. The opening (e.g., 130, 530, 630) can be a geometric shape that is smaller in size than the base 110. In a preferred embodiment, as shown generally in FIGS. 1 and 6, the bottom of the opening (e.g., 130, 630) is the top piece of storage compartment 300. In another embodiment, the opening 530 may have a depth that exceeds the thickness of the seat and eliminates a portion of the storage compartment 300. In another embodiment, the opening may be a through hole eliminating a section of the storage compartment. In one embodiment, the seat may have a uniform thickness throughout, such as shown in seat 120 of FIG. 1. In another embodiment, the seat may have a thickness that tapers, increasing in depth from less than 2 inches at the edge of the seat that is proximate to the back support column 440 to at least 2 inches at the edge of the seat that is distal from the back support column, such as shown in seats 420 (FIG. 4) and/or 620 (FIG. 6). The seat (e.g., 120, 420, 620) can be made from a polymeric material including vinyl, polycanvas, polyester, foam, plastic, fabric wrapped cushions, or 3D printed material. In one embodiment, the bottom of seat 120 hinges upward from storage compartment 300 towards the back support column 140 so that the user can access the contents of the storage compartment as shown generally in FIG. 3. In another embodiment, the seat may hinge upward from the storage compartment (e.g., 300) away from the back support column (e.g., 140) so that the user can access the contents of storage compartment. In another embodiment, another type of fastener may be used such as a magnet, snap fit, or rope. In yet another embodiment, the seat may slide away from its position on top of storage compartment to provide the user with access to the storage compartment. In another embodiment, the storage compartment may be accessible from side walls 180 of storage compartment 300 or the bottom of base 110.

Storage compartment 300 can be located between base 110 and the seat (e.g., 120, 420, 620) of the portable chair apparatus (e.g., 100, 400, 600). The storage compartment 300 may comprise one large compartment or multiple compartments 310, 320 that are smaller than the surface area of the seat (e.g., 120, 420, 620), as shown generally in FIG. 3. Storage compartment 300 can be temperature controlled to regulate the contents of the storage compartment during heat or cold and to protect against additional heat load added by the user sitting on top of the seat (e.g., 120, 420, 620). In another embodiment, storage compartment 300 may include some compartments that are temperature controlled while others are not. In yet another embodiment, the storage compartment 310 is sized such that it can store a one or more bottles and/or cans, such as bottles or cans or water, soda, beer, etc. A similar compartment 320 can be sized so that it can store a pair of gloves, hand warmers, ear plugs, or other similarly sized accessory.

Figure 7:
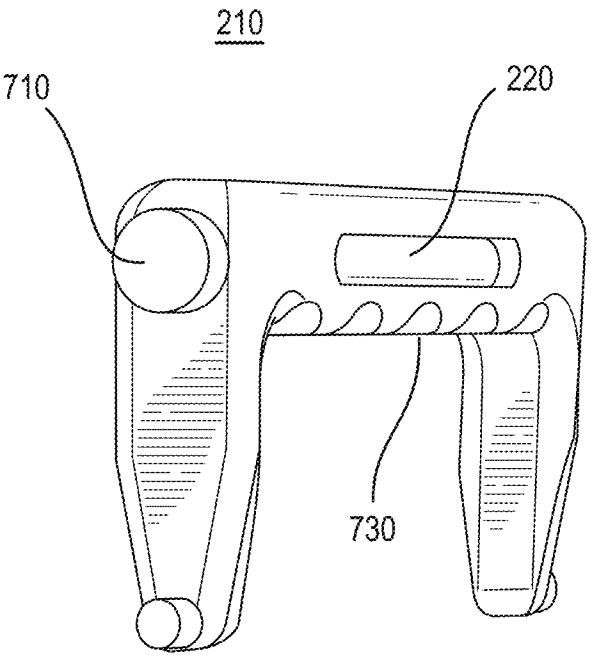
FIG. 7 is a front, side view of the handle of FIG. 2, according to an embodiment of the present invention.

The back support column (e.g., 140, 440) can be adjustable relative to the seat (e.g., 120, 420, 620) between an open position as shown in FIGS. 1, 3, 5, and 6 and a closed position as shown in FIGS. 2 and 4. For example, the back support column can rotate about a hinge at the rear of the seat. The back support column (e.g., 140, 440) is attached to the base or the side walls of the storage compartment by the back support column mount (e.g., 190, 690 as shown generally in FIGS. 1 and 6). The open position of the back support column 140, 440 can be oriented between approximately 90 and approximately 160 degrees from the base 110. The closed position of the back support column 140, 440 can be oriented between approximately 0 and approximately 45 degrees from the base 110. The back support column 140, 440 cam lock in place when it is engaged within approximately 10 degree increments within the open position range such that the user can lean back while sitting on the chair within a range of approximately 5 degrees. The back support column (e.g., 140, 440) can lock in place when it is engaged in the closed position range. The back support column (e.g., 140, 440) can be extendable to a length of approximately 4 feet to accommodate different heights of the user and provide support to the upper neck area if desired by the user. In one embodiment, as shown in FIG. 7, a button or pressure switch 710 of handle 210 may be engaged by the user to release the back support column (e.g., 140, 440) from a locked position or to turn on a light 220 that is housed within handle 210. In another embodiment, the light and/or button or pressure switch 710 may be housed within a component that does not function as a handle. In a preferred embodiment, wheels may be fastened to the base 110 or side walls 180 of the chair so that the chair can be rolled during transport. The wheels can be locking wheels to permit the chair to be positioned in one place when in use, without moving. In another embodiment, the wheels may retract so that the base of the seat can latch on to the surface of a bleacher or other pre-existing surface.

The back support column (e.g., 140, 440) can be in the shape of a square, a rectangle, a circle, or any other geometric shape. In one embodiment, there may be two back support columns fastened to the rear exterior of the storage compartment 300, base 110, or side walls 180, and supporting one or more lumbar support pieces 150. In one embodiment, two back support columns may engage in a locked position at substantially the same angle in relation to the user. In another embodiment, one back support column may engage in a locked position at an angle in the open position that is different from the angle that another back support column is engaged at in the open position. For example, one back support column may comprise a lumbar support piece for the user's head or neck to rest against while another back support column may comprise a lumbar support piece for the user's lower back to rest against. In yet another embodiment, a second back support may be attached to the exterior of storage compartment 300, base 110, or side walls 180 such that the it can retain a lumbar support piece that is perpendicular to the face of the first lumbar support piece.

Lumbar support piece 150 can be adjustable along the back support column (e.g., 140, 440). Lumbar support piece 150 can be sized to fit at least partially within the opening of the seat (e.g., 130, 530, 630) when the back support column (e.g., 140, 440) is in the closed position, as shown generally in FIGS. 2 and 4. Lumbar support piece 150 can be in the shape of a square, a rectangle, a circle, oval, or any other geometric shape. Lumbar support piece 150 can be a geometric shape that is smaller in size than the opening of the seat (e.g., 130, 530, 630). Lumbar support piece 150 may partially fit within opening 530 and partially rest on the seat 420 when the back support column is in the closed position, as shown generally in FIG. 4. Lumbar support piece 150 can be removably attached to the back support column (e.g., 140, 440). The removable attachment can be achieved by hook and loop, a clip, or a snap fit. In an embodiment, lumbar support piece 150 may be detached from the back support column (e.g., 140, 440) when the back support column is in the open or closed position. In another embodiment, lumbar support piece 150 may be attached at a number of different locations on the back support column (e.g., 140, 440). In one embodiment, the lumbar support piece 150 can have a height that is at least approximately 6 inches, a width that is at least approximately 8 inches, and/or a thickness that is at least approximately 2.4 inches.

Handles 160 and/or 210, as shown generally in FIGS. 1, 2, and 7, are accessible to the user for transport of the apparatus. In one embodiment, handle 160 is on back support column 140 and is accessible to the user when the back support column is in the closed position, as shown in FIG. 2, and/or in the open position, as shown in FIG. 1. In the same or another embodiment, handle 210 is attached to side wall 180 of storage compartment 300 and is accessible to the user when back support column 140 is in the closed position, as shown in FIG. 2. Handle 160 and/or 210 may also be accessible to the user when the back support column is in the open position and may be used to assist the user with closing or adjusting the angle of the back support column. In some embodiments (not shown), a handle may be located on the exterior surface of the storage compartment 300 to assist the user with accessing the contents of the storage compartment 300. The handles (e.g., 160, 210) may include a grip surface or grooves (e.g., 730) for the user's hands as shown generally in FIG. 7 to provide additional comfort and/or grip when force is exerted on the handle. In another embodiment, the handle may be a shoulder strap to assist the user in transporting the apparatus when the back support column is in the closed position. The button or pressure switch 710 may also be a colored light. In one embodiment, button or pressure switch 710 may releasably engage storage compartment 300 so that the user may access the contents of storage compartment 300. In another embodiment, button or pressure switch 710 may releasably engage the back support column (e.g., 140, 440) so that the user may lean back, open, or close the back support column (e.g., 140, 440). In yet another embodiment, button or pressure switch 710 may allow the user to rotate lumbar support piece 150.

In one embodiment, light 170 is housed on back support column 140 within handle 160 that is on and part of back support column 140. In another embodiment, light 170 can comprise a strip of lights, such as a flexible strip of LED lights, positioned on handle 160 or otherwise on the back support column (e.g., 140, 440). Light 220 can be oriented in a direction to illuminate a space in front of the user when holding the chair (e.g., 100, 400, 600) by the handle 210 when the back support column 140 is in the closed position, as shown generally in FIG. 2. The orientation of the light 220 may be adjustable so that the illumination will shine in the direction preferred by the user to enhance safety while using or transporting the chair. In a stadium like venue, many people may use chairs with similar visual appearance. A colored light, or colored lights with a combination of colors, may be used to signal to the user that the chair is their chair when the user returns to their chair upon departure. In one embodiment, the light 170 may be a colored light to display team spirit. In another embodiment, the light (e.g., 170, 220) can include a reflective pattern may be used to signal to the user that the chair is theirs. The light (e.g., 170, 220) may be battery powered, and portable chair apparatus 100 may include a battery pack or a pouch. In one embodiment, the LED light or strips can have an intensity of at least 100 lumens, such as 100-1000 lumens. In one embodiment, the LED light or strips can be high intensity light strips having an aggregate intensity in the range of 1000-3600 lumens. Other configurations are within the scope of the present invention, such as higher or lower intensities. In one embodiment, the lights (e.g., 170, 220) are LED lights that are turned on or off by a switch or switches (e.g., a pressure switch). Handles 160 and/or 210 can be rotated when the back support column is in the open or closed position, in order to position the light (e.g., 170, 220) as desired by the user. In one embodiment, the handle (e.g., 160, 210) functions as a housing for the lights and for a power source (e.g., battery) for powering the lights. Button or pressure switch 710 on the handle (e.g., 160, 210) can turn the light (e.g., 170, 220) on and off. It is understood that the lights (e.g., 170, 220) can have a different configuration within the scope of the present invention, and that the chair need not include the lights (e.g., 170, 220) on the handles (e.g., 160, 210) within the scope of the present invention.

The portable chair apparatus (e.g., 100, 400, 600) can be customized according to a user's desires. For example, the textured surface(s) of the portable chair apparatus can include a school, business, or team name, logo, or mascot for illumination by the lights (e.g., 170, 220). Storage compartments 300, 310, and/or 320 can be a colored plastic, if desired. The lights (e.g., 170, 220) can be LED lights capable of changing colors. For example, the light can be a red, green, or blue, or a selectable combination thereof. Optionally, some or all of the lights can be set to flashing, strobe, constant, or other setting upon selection of the user. Optionally, some or all of the lights can be dimmable. In one embodiment, some or all of the lights are controlled by remote. A user can turn the lights on and off using a remote, and can choose the color of the lights and the light setting and/or intensity (if applicable; e.g., flashing, constant, dimming level) using the remote. For example, the textured side can include a team logo, and the user can choose to illuminate the chair with lights the same colors as the team logo.

It will be understood that various features of the aspects of the cooler described herein may be used in combination with, or instead of, particular features of another aspect. Having provided the disclosure in detail, it will be apparent that modifications and variations are possible without departing from the scope of the disclosure defined in the appended claims. For example, to one of ordinary skill in the art, it will be readily apparent that various elements of FIGS. 1-8 can be interchanged or otherwise modified. As another example, one or more of the procedures, processes, or activities of FIG. 9 may include different procedures, processes, and/or activities and be performed in many different orders. Furthermore, it should be appreciated that all examples in the present disclosure are provided as non-limiting examples.

What is claimed is:

1. A portable chair comprising:
a base;
a seat for receiving a user thereon, wherein:
the seat comprises an opening;
a storage compartment located between the base and the seat;
a back support column that is adjustable relative to the seat between an open position and a closed position;
a lumbar support piece that is adjustable along the back support column, wherein:
the lumbar support piece is sized to fit within the opening of the seat when the back support column is in the closed position;
a handle that is accessible to the user for transport of the portable chair when the back support column is in the closed position; and
a first light on the back support column, wherein:
when the back support column is in the closed position, the first light is oriented to illuminate a space in front of the user when the user is holding the portable chair by the handle.

2. The portable chair as recited in claim 1, wherein:
the open position of the back support column is between 90 and 160 degrees from the base and the closed position is between 0 and 45 degrees from the base.

3. The portable chair as recited in claim 1, wherein:
the seat has a thickness that tapers, increasing in depth from less than 2 inches at an edge of the seat that is proximate to the back support column to at least 2 inches at an edge of the seat that is distal from the back support column.

4. The portable chair as recited in claim 1, wherein:
the lumbar support piece is removably attached to the back support column.

5. The portable chair as recited in claim 1, wherein:
the first light is an LED colored light.

6. The portable chair as recited in claim 1, wherein
the first light is adjustable to display different colors.

7. The portable chair as recited in claim 1, further comprising a second light on a second handle.

8. The portable chair as recited in claim 7, wherein:
the second light is oriented to illuminate the space in front of the user when the user is holding the portable chair by the second handle.

9. The portable chair as recited in claim 7, wherein:
the second handle is accessible to the user when the back support column is in the closed position.

10. The portable chair as recited in claim 1, wherein:
a height of the lumbar support piece is at least approximately 6 inches;
a width of the lumbar support piece is at least approximately 8 inches; and
a thickness of the lumbar support piece is at least approximately 2.4 inches.

11. A method of providing portable chair, the method comprising:
providing a base;
providing a seat for receiving a user thereon, wherein:
the seat comprises an opening;
providing a storage compartment located between the base and the seat;

providing a back support column that is adjustable relative to the seat between an open position and a closed position;

providing a lumbar support piece that is adjustable along the back support column, wherein:

the lumbar support piece is sized to fit within the opening of the seat when the back support column is in the closed position;

providing a handle that is accessible to the user for transport of the portable chair when the back support column is in the closed position; and providing a first light on the back support column, wherein:

when the back support column is in the closed position, the first light is oriented to illuminate a space in front of the user when the user is holding the portable chair by the handle.

12. The method as recited in claim 11, wherein, the open position of the back support column is between 90 and 160 degrees from the base and the closed position is between 0 and 45 degrees from the base.

13. The method as recited in claim 11, wherein, the seat has a thickness that tapers, increasing in depth from less than 2 inches at an edge of the seat that is proximate to the back support column to at least 2 inches at an edge of the seat that is distal from the back support column.

14. The method as recited in claim 11, wherein, the lumbar support piece is removably attached to the back support column.

15. The method as recited in claim 11, wherein:

the first light is an LED colored light.

16. The method as recited in claim 11, wherein: the first light is adjustable to display different colors.

17. The method as recited in claim 11, further comprising providing a second light on a second handle.

18. The method as recited in claim 17, wherein:

the second light is oriented to illuminate the space in front of the user when the user is holding the portable chair by the second handle.

19. The method as recited in claim 17, wherein:

the second handle is accessible to the user when the back support column is in the closed position.

20. The method as recited in claim 11, wherein:

a height of the lumbar support piece is at least approximately 6 inches;

a width of the lumbar support piece is at least approximately 8 inches; and a thickness of the lumbar support piece is at least approximately 2.4 inches.

* * * * *